US010845048B2

(12) United States Patent
Byman et al.

(10) Patent No.: US 10,845,048 B2
(45) Date of Patent: Nov. 24, 2020

(54) METHOD AND APPARATUS FOR RECOVERY OF HEAT FROM BULK SOLIDS

(71) Applicant: SOLEX THERMAL SCIENCE INC., Calgary (CA)

(72) Inventors: Ashley D. Byman, Heritage Pointe (CA); Jordison Neville, Millarville (CA); Robert McGillivray, Calgary (CA)

(73) Assignee: SOLEX THERMAL SCIENCE INC., Calgary (CA)

( * ) Notice: Subject to any disclaimer, the term of this patent is extended or adjusted under 35 U.S.C. 154(b) by 252 days.

(21) Appl. No.: 15/610,238

(22) Filed: May 31, 2017

(65) Prior Publication Data

US 2018/0347806 A1 Dec. 6, 2018

(51) Int. Cl.

| | |
|---|---|
| ***F22B 1/00*** | (2006.01) |
| ***F22B 1/04*** | (2006.01) |
| ***F27D 17/00*** | (2006.01) |
| ***F22D 1/00*** | (2006.01) |
| ***F22G 1/00*** | (2006.01) |

(52) U.S. Cl.

CPC ..... *F22B 1/04* (2013.01); *F22D 1/00* (2013.01); *F22G 1/00* (2013.01); *F27D 17/004* (2013.01); *F27D 2017/006* (2013.01)

(58) Field of Classification Search

CPC .... F22B 1/04; F22B 1/02; F27D 17/00; F22D 1/00; F22G 1/00; F28D 9/0068; C21B 3/06

See application file for complete search history.

(56) References Cited

U.S. PATENT DOCUMENTS

| | | | | |
|---|---|---|---|---|
| 1,803,081 A | | 4/1931 | Uhle et al. | |
| 5,762,031 A | * | 6/1998 | Gurevich | F22B 1/1815 122/1 C |
| 2014/0246196 A1 | * | 9/2014 | Larkin | F22B 1/22 166/272.3 |
| 2016/0025417 A1 | * | 1/2016 | Byman | F28F 3/14 165/166 |

FOREIGN PATENT DOCUMENTS

| | | | |
|---|---|---|---|
| CN | 104048284 A | * | 9/2014 |
| CN | 104048284 A | | 9/2014 |
| CN | 105624349 A | * | 6/2016 |
| JP | 2015190726 A | | 11/2015 |

OTHER PUBLICATIONS

International Patent Application No. PCT/CA2018/050591, International Search Report and Written Opinion dated Aug. 21, 2018.

* cited by examiner

*Primary Examiner* — Travis C Ruby
*Assistant Examiner* — Harry E Arant
(74) *Attorney, Agent, or Firm* — Borden, Ladner, Gervais, LLP; Geoffrey Dekleine

(57) ABSTRACT

A method of heat recovery from bulk solids includes introducing the bulk solids into an inlet of a heat exchanger for indirect heat exchange with water as the bulk solids flow, by gravity, from the inlet to an outlet of the heat exchanger, pumping the water into subcritical heating heat transfer elements within the heat exchanger for indirect heat exchange with the bulk solids to heat the water and thereby provide heated, pressurized water, and flashing off steam from the heated, pressurized water.

21 Claims, 5 Drawing Sheets

METHOD AND APPARATUS FOR RECOVERY OF HEAT FROM BULK SOLIDS

FIELD OF TECHNOLOGY

The present invention relates to a method and apparatus for recovery of heat and steam generation from hot bulk solids, such as granulated slag.

BACKGROUND

Vast quantities of high temperature solids that are capable of flowing as bulk solids are produced in various processes. The solids are cooled prior to further processing and significant amounts of heat are wasted during cooling as the heat is lost to the atmosphere or inefficiently recovered.

In one particular example, large volumes of slag are produced during smelting in a blast furnace, to recover metals from ores. The slag produced may be at a temperature of 1200° C. or hotter when solidified and is then further cooled prior to disposal or use of the slag in, for example, cement or concrete.

Other materials such as coke, fly ash, and metals are also commonly cooled utilizing inefficient or no heat recovery.

Recovery of heat from such materials is desirable to improve energy efficiency and reduce operational cost of such processes.

SUMMARY

According to one aspect of an embodiment, a method is provided for heat recovery from bulk solids. The method includes introducing the bulk solids into an inlet of a heat exchanger for indirect heat exchange with water as the bulk solids flow, by gravity, from the inlet to an outlet of the heat exchanger, pumping the water into subcritical heating heat transfer elements within the heat exchanger for indirect heat exchange with the bulk solids to heat the water and thereby provide heated, pressurized water, and flashing off steam from the heated, pressurized water.

According to another embodiment, an apparatus is provided for recovery of heat from bulk solids. The apparatus includes a heat exchanger for indirect heat exchange with the bulk solids. The heat exchanger includes a housing including an inlet for receiving the bulk solids and an outlet for discharging the bulk solids, and a set of subcritical heating heat transfer elements disposed between the inlet and the outlet and arranged and constructed for the flow of water therethrough and for the flow of the bulk solids that flow from the inlet, between the heat transfer elements, to the outlet. The apparatus also includes a pump for pumping the water into the subcritical heating heat transfer elements within the heat exchanger for indirect heat exchange with the bulk solids to heat the water, and a flash vessel in fluid communication with the set of subcritical heating heat transfer elements for receiving the heated water and flashing off steam from the heated water.

BRIEF DESCRIPTION OF THE DRAWINGS

An embodiment of the present disclosure will now be described, by way of example only, with reference to the attached figures, in which.

DETAILED DESCRIPTION

Figure 1:
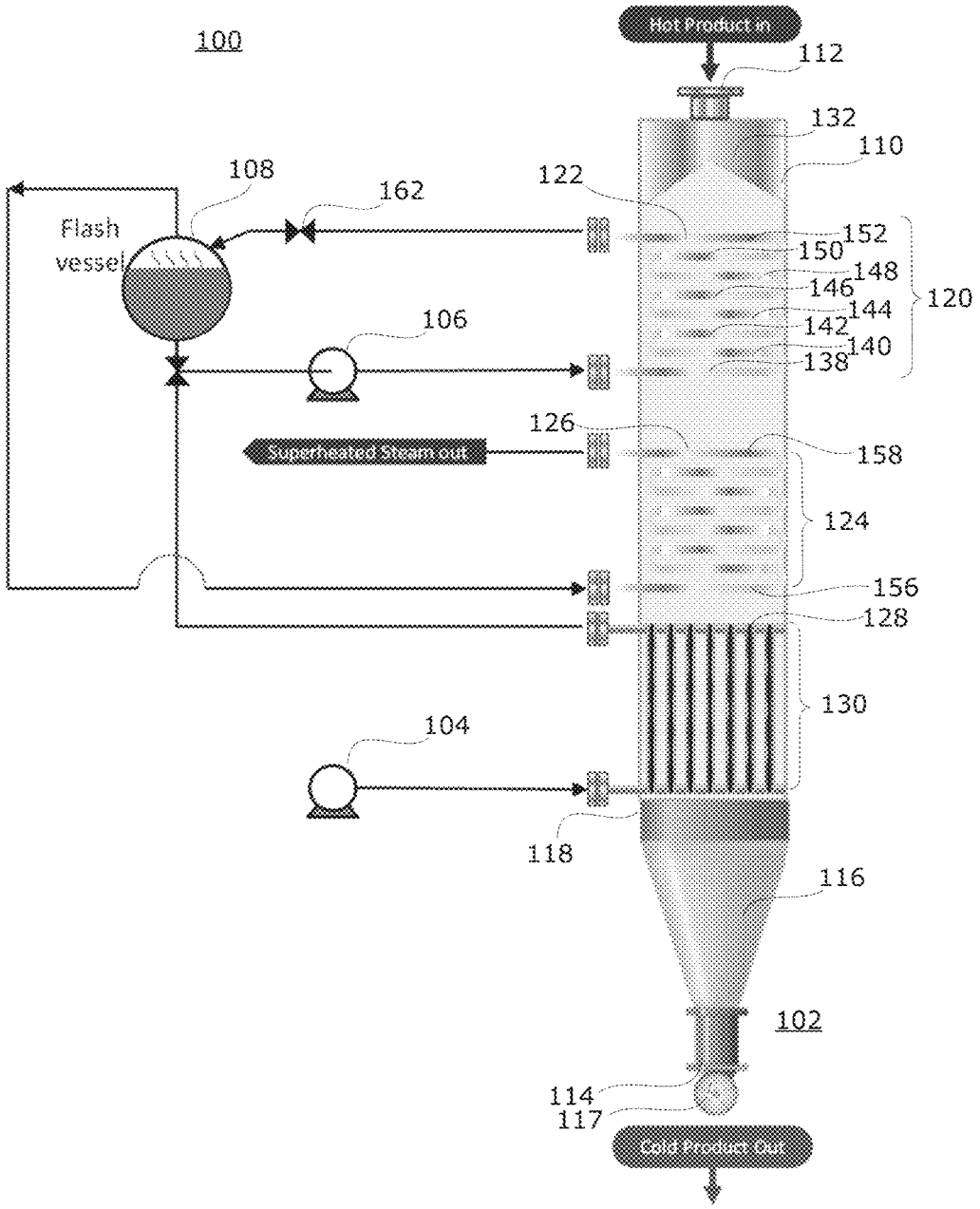
FIG. 1 is a schematic diagram illustrating an apparatus including a heat exchanger and showing process flow for recovery of heat from bulk solids according to an embodiment.

The following describes an apparatus and a method of heat recovery from high temperature bulk solids. The bulk solids are introduced into an inlet of a heat exchanger for indirect heat exchange with water as the bulk solids flow, by gravity, from the inlet to an outlet of the heat exchanger. The water is pumped into subcritical heating heat transfer elements within the heat exchanger for indirect heat exchange with the bulk solids to heat the water and thereby provide heated, pressurized water. Steam is flashed off from the heated, pressurized water.

The bulk solids may be any bulk solids at very high temperatures, such as, granulated slag, carbon, fly ash, coke, sand, minerals such as alumina, and metals such as aluminum, catalysts, char, and so forth. The very high temperatures of the bulk solids include temperatures in excess of 1000° C. For example, the bulk solids may be at a temperature of about 400° C. to about 1500° C. For example, the bulk solids may be at a temperature of about 1200° C.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

Figure 2:
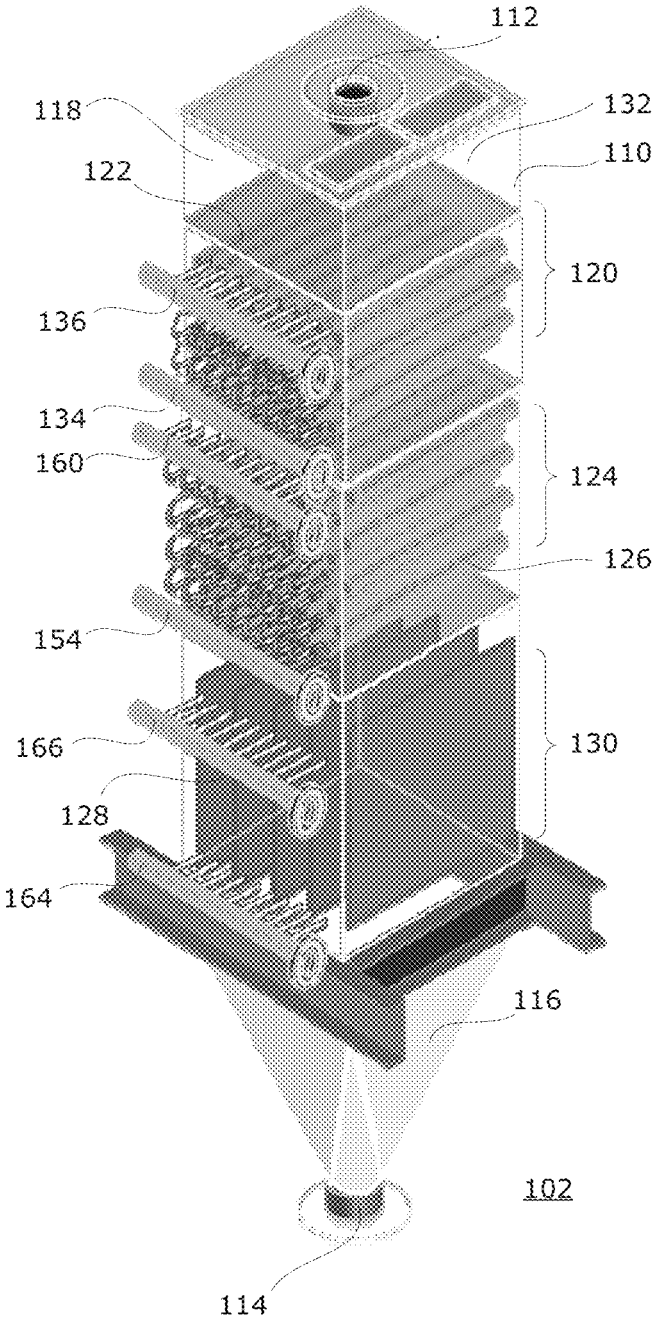
FIG. 2 is a perspective view of an example of a heat exchanger of FIG. 1.

A schematic diagram illustrating an example of an apparatus and process flow for recovery of heat from slag is shown in FIG. 1 and a heat exchanger of the apparatus is shown in FIG. 2. The apparatus 100 includes the heat exchanger 102 for indirect heat exchange with water as bulk solids flow, by gravity, through the heat exchanger 102. The apparatus 100 also includes pumps, including a first pump 104 and a second pump 106 for pressurizing the water utilized for heat exchange. A flash vessel 108 is utilized for generating saturated steam from the water. The apparatus 100 includes interconnecting piping, valves, controls, and interconnecting piping for fluid communication between the heat exchanger 102 and the flash vessel 108 as well as the pumps 104, 106 and for the control of the flow of water during heat exchange with the bulk solids.

The heat exchanger 102 includes a housing 110 that has a generally rectangular cross-section. An inlet 112 is provided at a top of the housing 110 for introducing bulk solids into the heat exchanger 102. The bulk solids introduced through the inlet 112, may be at a temperature of about 400 C-1500 C, for example. An outlet 114 is utilized for discharging the cooled bulk solids from the housing 110.

A discharge hopper 116 is disposed at the outlet 114 to create a mass flow or "choked flow" of bulk solids and to regulate the flow of the bulk solids through the heat exchanger. An example of a discharge hopper is described in U.S. Pat. No. 5,167,274, the entire content of which is incorporated herein by reference. The term "choked flow" is utilized herein to refer to a flow other than a free fall of the bulk solids as a result of the force of gravity.

Thus, the discharge hopper 116, located above the outlet 114, is utilized to control the flow of bulk solids to provide a generally uniform mass flow of the bulk solids out of the heat exchanger 102 and thus to control the residence time of the bulk solids in the heat exchanger 102. Further valves or control devices may be utilized to further control the discharge rate of the bulk solids out of the heat exchanger 102. In the example shown in FIG. 1, a rotary valve 117 or screw discharge is utilized to control the rate of discharge of bulk solids from the heat exchanger 102.

In the present example, the housing 110 of the heat exchanger 102 has a generally rectangular cross-section and includes four sides 118. The sides 118 of the housing 110 may optionally be sealed, for example, by seam welding along the sides 118.

Each of the sides 118 may be insulated, for example, utilizing a ceramic fibre sheet or refractory material, on an interior surface of the sides 118 to protect the sides 118 from high temperatures during the flow of bulk solids at high temperature, through the housing 110.

A plurality of heat transfer elements are disposed in the housing, between the inlet 112 and the outlet 114. The heat transfer elements include subcritical heating heat transfer elements for heating pressurized water by indirect heat exchange with the bulk solids. The subcritical heating heat transfer elements may be heat transfer tubes or heat transfer plate assemblies. Optionally, the heat transfer elements may also include preheating heat transfer elements, which may be heat transfer plate assemblies or heat transfer tubes. Optionally, further heat transfer elements may also be included for superheating steam after flashing off saturated steam from the heated, pressurized water.

The heat transfer elements in the present example include all three of the subcritical heating heat transfer elements, referred to herein as a first set 120 of heat transfer tubes 122, the superheating heat transfer elements, referred to herein as a second set 124 of heat transfer tubes 126, and the preheating heat transfer elements 122, referred to herein as a set of heat transfer plate assemblies 128. In the present example, the heat transfer plate assemblies 128 include a single bank 130 of heat transfer plate assemblies 128. Alternatively, the heat transfer plate assemblies 128 may include any suitable number of banks of plates.

The first set 120 of heat transfer tubes 122 are located closest to the inlet 112, relative to the second set 124 of heat transfer tubes 126 and the heat transfer plate assemblies 128. The first set 120 of heat transfer tubes 122 is sufficiently spaced from the inlet 112 to provide a feed hopper 132 in the housing 110, between the inlet 112 and the top of the first set 120 of heat transfer tubes 122. The feed hopper 132 facilitates distribution of the bulk solids that flow from the inlet 112, as a result of the force of gravity, over the first set 120 of heat transfer tubes 122.

The first set 120 of heat transfer tubes 122 may include any suitable number of heat transfer tubes 122 for subcritical heating of heated, pressurized water. For example, the first set 120, also referred to as subcritical heating heat transfer tubes 122, may be arranged in 8 rows, each including 5 heat transfer tubes 122. In each row, the heat transfer tubes 122 are arranged generally parallel to each other and are spaced apart to facilitate the flow of bulk solids between the heat transfer tubes 122. The rows of heat transfer tubes 122 are also spaced apart such that each row is vertically spaced from the adjacent row or rows.

Each heat transfer tube 122 includes a first end near a first side of the heat exchanger 102 and a second end, near an opposing, second side of the heat exchanger 102. The heat exchanger 102 includes a first tube inlet manifold 134 fluidly coupled by fluid lines to a first end of each heat transfer tube 122 of the lowest row 138 of the first set 120 of heat transfer tubes 122 for providing heated, pressurized water into each heat transfer tube 122 of the lowest row 138 of the first set 120. A second end of each heat transfer tube 122 in the lowest row 138 of the first set 120 is fluidly coupled, by coupling fluid lines, to a second end of a respective heat transfer tube 122 in the adjacent, second row 140 of the first set 120 of heat transfer tubes 122. A first end of each heat transfer tube 122 in the second row 140 of the first set 120 is fluidly coupled by coupling fluid lines, to a first end of a respective heat transfer tube 122 in the adjacent, third row 142 of the first set 120 of heat transfer tubes 122. Similarly, a second end of each heat transfer tube 122 in the third row 142 of the first set 120 is fluidly coupled by coupling fluid lines, to a second end of a respective heat transfer tube 122 in the adjacent, fourth row 144 of the first set 120 of heat transfer tubes 122 and so forth. Thus, with the exception of the top row 152 of heat transfer tubes 122, each heat transfer tube 122 in each row 138, 140, 142, 144, 146, 148, 150 is fluidly coupled to a respective heat transfer tube 122 in the above, adjacent row 140, 142, 144, 146, 148, 150, 152.

The first end of each heat transfer tube 122 of the top row 152 of the first set 120 is coupled by a discharge fluid line to a first tube discharge manifold 136 for the discharge of heated, pressurized water from the first set 120 of heat transfer tubes 122.

In use, heated, pressurized water flows from the first tube inlet manifold 134, into the first set 120 of heat transfer tubes 122, across the heat transfer tubes 122 in a serpentine manner as the heated, pressurized water flows upwardly, and out to the first tube discharge manifold 136. Thus, in the present example, the water flows upwardly, countercurrent to the downward flow of bulk solids.

The second set 124 of heat transfer tubes 126 are spaced from the first set 120 of heat transfer tubes 122, and are located between the first set 120 of heat transfer tubes 122 and the bank 130 of heat transfer plate assemblies 128. The second set 124 of heat transfer tubes 126 may include any suitable number of heat transfer tubes 126. The heat transfer tubes 126 of the second set 124 may be arranged in a similar manner to the heat transfer tubes 122 of the first set 120 or may differ in number of heat transfer tubes and numbers of rows. For the purpose of the present example, the second set 124 of heat transfer tubes 126 is arranged in 8 rows, each including 5 heat transfer tubes 126. In each row, the heat transfer tubes 126 are arranged generally parallel to each other and are spaced apart to facilitate the flow of bulk solids between the heat transfer tubes 126. The rows of heat transfer tubes 126 are also spaced apart such that each row is vertically spaced from the adjacent row or rows.

The heat exchanger 102 also includes a second tube inlet manifold 154 fluidly coupled by fluid lines to a first end of each heat transfer tube 126 of the lowest row 156 of the second set 124 of heat transfer tubes 126 for providing steam into each heat transfer tube 126 of the lowest row 156 of the second set 124. As described above with reference to the first set 120 of heat transfer tubes 122, with the exception of the top row 158 of heat transfer tubes 126, each heat transfer tube 126 in each row is fluidly coupled to a respective heat transfer tube 126 in the above, adjacent row.

The first end of each heat transfer tube 126 of the top row 158 of the second set 124 is coupled by a discharge fluid line to a second tube discharge manifold 160 for the discharge of superheated steam from the second set 124 of heat transfer tubes 126.

Similar to the first set 120 of heat transfer tubes 122, fluid, which in this case is steam, flows from the second tube inlet manifold 154, into the second set 124 of heat transfer tubes 126, across the heat transfer tubes 126 and in a serpentine manner as the steam flows upwardly, out to the second tube discharge manifold 160. Thus, in the present example, the steam flows upwardly, countercurrent to the downward flow of bulk solids.

The bank 130 of heat transfer plate assemblies 128 is spaced from the second set 124 of heat transfer tubes 126 and is disposed between the second set 124 of heat transfer tubes 126 and the discharge hopper 116. The bank 130 of heat transfer plate assemblies 128 includes a plurality of heat transfer plate assemblies 128 that are generally parallel to each other and are spaced apart to provide spaces between adjacent heat transfer plate assemblies 128 for the flow of bulk solids between the heat transfer plate assemblies 128. The bank 130 of heat transfer plate assemblies 128 may include any suitable number of heat transfer plate assemblies 128. Further banks of heat transfer plate assemblies may also be utilized in the housing 110. For the purpose of the present example, the bank 130 includes 7 heat transfer plate assemblies 128.

Figure 3:
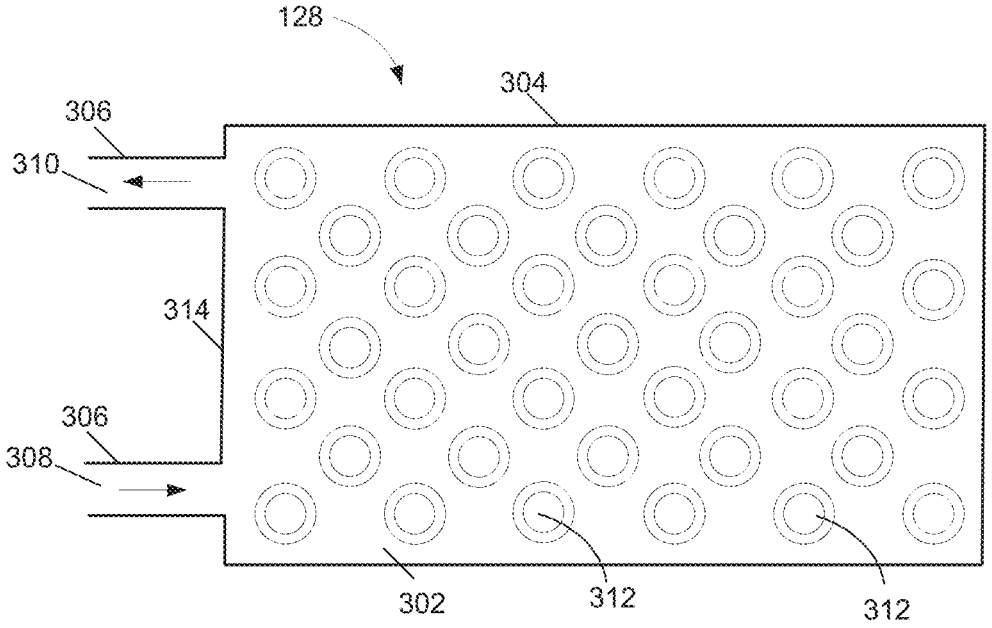
FIG. 3 is a sectional side view of a heat transfer plate assembly of the heat exchanger of FIG. 2.

An example of a heat transfer plate assembly 128 of the heat exchanger 102 is shown in FIG. 3. The heat transfer plate assembly 128 includes a pair of metal sheets 302 that are spot-welded together at several locations distributed over the sheets 302. The sheets are also seam welded or diffusion bonded along the edges 304 to join the edges together. After the two metal sheets 302 are welded together, slots are cut and nozzles 306 are inserted into the slots and welded to the sheets 302 to provide a fluid inlet 308 and a fluid outlet 310. The sheets 302 are expanded, such as, for example, by inflating utilizing the nozzles 306, to form passages through the sheets 302, where the sheets are not welded together, for the flow of fluid between the sheets 302. The locations at which the sheets 302 are welded together form dimples or generally circular depressions 312 when the remainder of the sheets are expanded. The generally circular depressions 312 are distributed over each sheet 302 and are located at complementary locations on each sheet 302 such that the depressions 312 on one of the sheets 302 are aligned with the depressions 312 on the other of the sheets 302. As a result of the circular depressions 312 formed by the spot-welds, the passages form non-linear or tortuous paths for fluid flow through the sheets 302.

In the heat exchanger 102, the fluid inlet 308 extends from a front edge 314 of the sheets 302 at a location near the bottom of the sheets 302. The fluid outlet 310 extends from the front edge 314, at a location near the top of the sheets 302.

Referring again to FIG. 1 and FIG. 2, a plate assembly inlet manifold 164 is fluidly coupled by fluid lines to the fluid inlet 308 of each of the heat transfer plate assemblies 128 for providing water into each of the heat transfer plate assemblies 128 for initial heating or preheating of the water, prior to further heating of the water in the first set 120 of heat transfer tubes 122. The fluid outlet 310 of each heat transfer plate assembly 128 is coupled by a respective discharge fluid line to a plate assembly discharge manifold 166 for the discharge of the preheated water that is further pressurized in the second pump 106 and then introduced into the first set 120 of heat transfer tubes 122.

The water flows from the plate assembly inlet manifold 164, through the heat transfer plate assemblies 128 along non-linear or tortuous paths, and out to the plate assembly discharge manifold 166.

In use, the high temperature bulk solids are introduced into the heat exchanger 102 and flow downwardly, by the force of gravity, through the feed hopper 132, between the first set 120 of heat transfer tubes 122, between the second set 124 of heat transfer tubes 126, and between the heat transfer plate assemblies 128, through the discharge hopper 116 and out the outlet 114. The high temperature bulk solids are cooled by the heated, pressurized water as the bulk solids flow between the first set 120 of heat transfer tubes 122, the superheated steam as the bulk solids between the second set 124 of heat transfer tubes 126, and the water during preheating of the water in the heat transfer plate assemblies 128, as the bulk solids flow between the heat transfer plate assemblies 128.

Water is pressurized utilizing the first pump 104 and the pressurized water is fed to the plate assembly inlet manifold 164. The pressurized water flows to the fluid inlet 308 of each of the heat transfer plate assemblies 128, through the heat transfer plate assemblies 128, and out the fluid outlet 310 of each of the heat transfer plate assemblies 128, to the plate assembly discharge manifold 166. The pressurized water is preheated by the bulk solids as the bulk solids flow between the heat transfer plate assemblies 128.

The water from the plate assembly discharge manifold 166 is then further pressurized in the second pump 106 and fed to the first tube inlet manifold 134, and into the first set 120 of heat transfer tubes 122, across the heat transfer tubes 122 in a serpentine manner as the water flows upwardly, and out to the first tube discharge manifold 136. The heated, pressurized water is heated by heat exchange with the bulk solids that flow through the spaces between the heat transfer tubes 122 of the first set 120.

The heated, pressurized water from the first tube discharge manifold 136 passes through a restriction 162 such as a valve or orifice plate to reduce the pressure and is introduced to the flash vessel 108 to generate saturated steam. The remaining water from the flash vessel is mixed with the preheated water from the plate assembly discharge manifold 166 and is fed back to the second pump 106. The saturated steam from the flash vessel 108 flows to the second tube inlet manifold 154 and into the second set 124 of heat transfer tubes 126. The steam flows across the heat transfer tubes 126 and in a serpentine manner as the steam flows upwardly, and out to the second tube discharge manifold 160, superheating the steam by heat exchange with the bulk solids as the bulk solids flow in the spaces between the heat transfer tubes 126 of the second set 124. Thus, superheated steam exits the second tube discharge manifold 160. The reduction in pressure as the water passes through the restriction 162 affects the volume of water that is flashed off in the flash vessel. A larger or greater pressure drop results in more saturated steam being flashed off at a lower working pressure. If too little steam is flashed off, the volume of water that is recirculated is high. If too much steam is flashed off, the system pressure is greater.

The pressure of the superheated steam from the heat exchanger 102 is about equal to the pressure of the water from the flash vessel 108 and is about equal to the pressure of the water entering the second pump 106. The second pump 106 is then utilized to increase the pressure. Thus, the pressure of the water from the first pump 104 is set based on the desired pressure of the superheated steam from the heat exchanger 102.

In a particular example in which the bulk solids comprise slag particles, the bulk solids may be introduced to the heat exchanger 102 at a temperature of, for example, about 1200° C. The bulk solids are cooled by heat exchange with the water in the first set 120 of heat transfer tubes 122, to a temperature of, for example, about 340° C. The bulk solids are then cooled by heat exchange with the steam in the second set 124 of heat transfer tubes 126 to a temperature of, for example, about 290° C. As the bulk solids pass between the heat transfer plate assemblies 128, the bulk solids are further cooled by the pressurized water and the bulk solids exit the heat exchanger 102 at a temperature of, for example, about 70° C.

The water at about 20° C. is pressurized by the first pump 104 to a pressure of, for example, about 20 bar(g). The water is preheated in the heat transfer plate assemblies 128 to a temperature of, for example, about 152° C. The preheated water is mixed with the water from the flash vessel 108 and the combined water at a temperature of, for example, about 205° C. is pressurized by the second pump 106 to a pressure of, for example, about 60 bar(g). The water is then further heated in the first set 120 of heat transfer tubes 122, to a temperature of, for example, about 277° C., and saturated steam is flashed off in the flash vessel 108 at a pressure of, for example, about 20 bar(g). The resulting saturated steam, at a pressure of, for example, about 20 bar(g) and a temperature of, for example, about 215° C., is superheated in the second set 124 of heat transfer tubes 126, to a temperature of, for example, about 280° C.

The flow of bulk solids is controlled by the discharge hopper 116 to control residence time of the bulk solids in the heat exchanger 102. The flow rate of water and steam, and the pressure are controlled to control the heating of water and the steam in the heat exchanger.

Advantageously, the subcritical heating of the pressurized water in first set 120 of heat transfer tubes 122, which are located closest to the inlet 112, followed by flashing off saturated steam and then superheating the steam in the less hot area of the heat exchanger 102, which is the second set 124 of heat transfer tubes 126, facilitates control of the temperature of the water and the superheated steam that is produced.

As indicated above, the preheating heat transfer elements, which may be heat transfer plate assemblies or heat transfer tubes are optional. Similarly, the further heat transfer elements for superheating steam after flashing off of steam from the heated, pressurized water are also optional. The heat exchanger may include only the heat transfer elements for heating the pressurized water, may include either one or both of the preheating heat transfer elements and further heat transfer elements.

Figure 4:
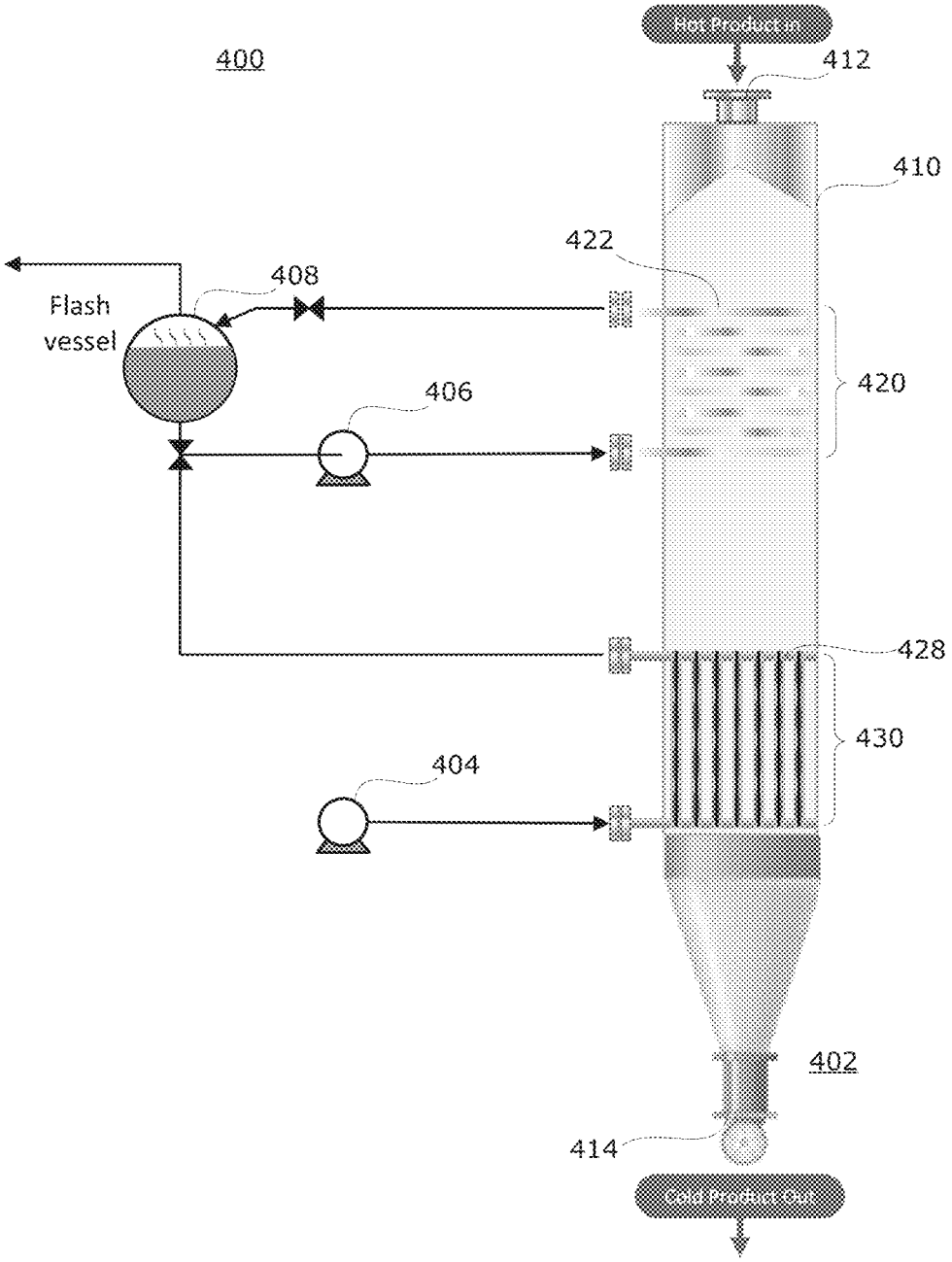
FIG. 4 is a schematic diagram illustrating an apparatus including a heat exchanger and showing process flow for recovery of heat from bulk solids according to another embodiment.

Reference is made to FIG. 4, which shows an apparatus 400 including a heat exchanger 402 and showing process flow for recovery of heat from bulk solids according to another embodiment. The present embodiment is similar to the embodiment shown in FIG. 1 and described above, with the exception that the embodiment shown in FIG. 4 does not include the further heat transfer elements, also referred to as the second set of heat transfer tubes, that are utilized in the example of FIG. 1 to superheat the steam.

The apparatus 400 shown in FIG. 4 includes a heat exchanger 402 for indirect heat exchange with water as bulk solids flow, by gravity, through the heat exchanger 402. The apparatus 400 also includes pumps, including a first pump 404 and a second pump 406 for pressurizing the water utilized for heat exchange. A flash vessel 408 is utilized for generating saturated steam from the water. The apparatus 400 includes interconnecting piping, valves, controls, and interconnecting piping for fluid communication between the heat exchanger 402 and the flash vessel 408 as well as the pumps 404, 406 and for the control of the flow of water during heat exchange with the bulk solids.

The heat exchanger 402 includes a housing 410 that, for the purpose of this example, is similar to that described with reference to FIG. 1.

A plurality of heat transfer elements are disposed in the housing 410, between the inlet 412 and the outlet 414. The heat transfer elements in the present example include the first set 420 of heat transfer tubes 422, and the preheating heat transfer elements 422, referred to herein as a bank 430 of heat transfer plate assemblies 428.

In use, the high temperature bulk solids are introduced into the heat exchanger 402 and flow downwardly, by the force of gravity, between the first set 420 of heat transfer tubes 422, and between the heat transfer plate assemblies 428, and out the outlet 414. The high temperature bulk solids are cooled by the heated, pressurized water as the bulk solids flow between the first set 420 of heat transfer tubes 422, and the water during preheating of the water in the heat transfer plate assemblies 428, as the bulk solids flow between the heat transfer plate assemblies 428.

Water is pressurized utilizing the first pump 404 and the pressurized water flows through the heat transfer plate assemblies 428. The pressurized water is then further pressurized in the second pump 406 and flows through the first set 420 of heat transfer tubes 422. The heated, pressurized water is heated by heat exchange with the bulk solids that flow through the spaces between the heat transfer tubes 422 of the first set 420.

The heated, pressurized water passes through a restriction such as a valve or orifice plate to reduce the pressure and is introduced to the flash vessel 408 to generate the saturated steam. The remaining water from the flash vessel is mixed with the preheated water and is fed back to the second pump 406.

Figure 5:
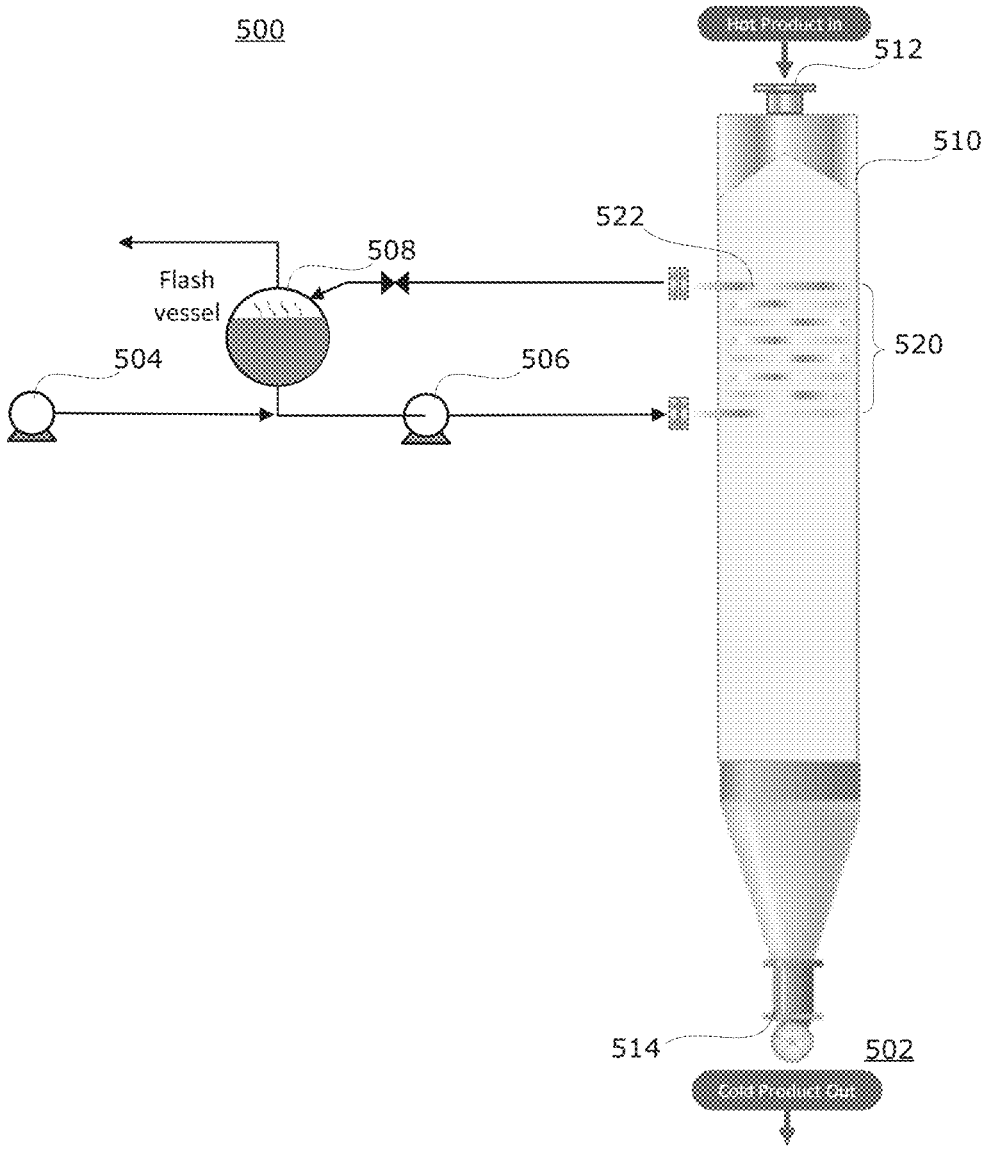
FIG. 5 is a schematic diagram illustrating an apparatus including a heat exchanger and showing process flow for recovery of heat from bulk solids according to yet another embodiment.

Reference is now made to FIG. 5, which shows an apparatus 500 including a heat exchanger 502 and showing process flow for recovery of heat from bulk solids according to yet another embodiment. The present embodiment is similar to the embodiment shown in FIG. 1 and described above, with the exception that the embodiment shown in FIG. 4 does not include the preheating heat transfer elements, also referred to as a set of heat transfer plate assemblies, and does not include the further heat transfer elements, also referred to as the second set of heat transfer tubes, that are utilized in the example of FIG. 1 to superheat the steam.

The apparatus 500 shown in FIG. 5 includes a heat exchanger 502 for indirect heat exchange with water as bulk solids flow, by gravity, through the heat exchanger 502. The apparatus 500 also includes pumps, including a first pump 504 and a second pump 506 for pressurizing the water utilized for heat exchange. A flash vessel 508 is utilized for generating saturated steam from the water. The apparatus 500 includes interconnecting piping, valves, controls, and interconnecting piping for fluid communication between the heat exchanger 502 and the flash vessel 508 as well as the pumps 504, 506 and for the control of the flow of water during heat exchange with the bulk solids.

The heat exchanger 502 includes a housing 510 that, for the purpose of this example, is similar to that described with reference to FIG. 1.

A plurality of heat transfer elements are disposed in the housing 510, between the inlet 512 and the outlet 514. The heat transfer elements in the present example include only the set 520 of subcritical heating heat transfer tubes 522.

In use, the high temperature bulk solids are introduced into the heat exchanger 502 and flow downwardly, by the force of gravity, between the set 520 of heat transfer tubes 522 and out the outlet 514. The high temperature bulk solids are cooled by the heated, pressurized water as the bulk solids flow between the set 520 of heat transfer tubes 522.

Water is pressurized utilizing the first pump 504 and the pressurized water is mixed with recirculated water from the flash vessel 508, is further pressurized in the second pump 506, and flows through the set 520 of heat transfer tubes 522. The heated, pressurized water is heated by heat exchange with the bulk solids that flow through the spaces between the heat transfer tubes 522 of the first set 520.

The heated, pressurized water passes through a restriction such as a valve or orifice plate to reduce the pressure and is introduced to the flash vessel 508 to generate the saturated steam. The remaining water from the flash vessel is then recirculated back to the second pump 506.

Advantageously, the subcritical heating of the pressurized water in set of heat transfer tubes facilitates the generation of steam from the high temperature bulk solids.

The scope of the claims should not be limited by the preferred embodiments set forth in the examples, but should be given the broadest interpretation consistent with the description as a whole.

What is claimed is:

1. A method of heat recovery from bulk solids, the method comprising:

introducing the bulk solids into an inlet of a heat exchanger for indirect heat exchange with water as the bulk solids flow, by gravity, from the inlet to an outlet of the heat exchanger;

pumping water, utilizing a first pump, to increase a pressure of the water from an initial pressure to a first pressure, which is greater than the initial pressure and introducing the water at the first pressure into preheating heat transfer elements within the heat exchanger for indirect heat exchange with the bulk solids to heat the water;

pumping, utilizing a second pump, the water from the preheating heat transfer elements after preheating, and water from a flash vessel, wherein the water from the preheating heat transfer elements and the water from the flash vessel are combined outside the flash vessel and pumped utilizing the second pump, the second pump pumping to a second pressure that is greater than the first pressure, into first heat transfer elements disposed between the inlet and the preheating heat transfer elements in the heat exchanger;

after the water passes through the first heat transfer elements, passing the water through a restriction, reducing pressure of the water to the first pressure prior to introducing the water to the flash vessel, and introducing the water to the flash vessel and flashing off steam in the flash vessel;

wherein the water from the preheating heat transfer elements is only introduced into the flash vessel after passing through the first heat transfer elements at the second pressure.

2. The method according to claim 1, comprising pumping the water at a first temperature and the first pressure into the preheating heat transfer elements for indirect heat exchange with the bulk solids to heat the water to a second temperature, higher than the first temperature, prior to pumping the water into the first heat transfer elements at the second pressure.

3. The method according to claim 2, comprising introducing the steam into further heat transfer elements within the heat exchanger for indirect heat exchange with the bulk solids to provide superheated steam, wherein the further heat transfer elements are disposed between the preheating heat transfer elements and the first heat transfer elements.

4. The method according to claim 2, wherein the pumping the water at the first temperature and the first pressure into the preheating heat transfer elements within the heat exchanger comprises pumping the water into heat transfer plate assemblies arranged generally parallel to each other for the flow of the water through the heat transfer plate assemblies and the flow of the bulk solids between the heat transfer plate assemblies.

5. The method according to claim 1, comprising introducing the steam into further heat transfer elements within the heat exchanger for indirect heat exchange with the bulk solids to provide superheated steam.

6. The method according to claim 1, wherein pumping the water into the first heat transfer elements within the heat exchanger comprises pumping the water into first heat transfer tubes for the flow of water through the first heat transfer tubes and the flow of the bulk solids between the first heat transfer tubes.

7. The method according to claim 1, wherein introducing the steam into the further heat transfer elements within the heat exchanger comprises introducing the steam into steam heat transfer tubes for the flow of steam through the steam heat transfer tubes and the flow of the bulk solids between the steam heat transfer tubes.

8. The method according to claim 1, wherein flow of the bulk solids through the heat exchanger is choked.

9. The method according to claim 1, comprising controlling a flow rate of the bulk solids through the heat exchanger and thus, residence time in the heat exchanger, utilizing a discharge hopper disposed proximal the outlet.

10. The method according to claim 1, wherein the second pressure is 60 bar(g).

11. The method according to claim 10, wherein the first pressure is 20 bar(g).

12. An apparatus for recovery of heat from bulk solids, the apparatus comprising:

a heat exchanger for indirect heat exchange with the bulk solids, the heat exchanger including a housing including an inlet for receiving the bulk solids and an outlet for discharging the bulk solids, a first set of heat transfer elements disposed between the inlet and the outlet and arranged and constructed for the flow of water therethrough and for the flow of the bulk solids that flow from the inlet, between the heat transfer elements, to the outlet; and a set of preheating heat transfer elements disposed between the first set of heat transfer elements and the outlet and arranged and constructed for the flow of water therethrough and for the flow of the bulk solids that flow from the inlet, between the heat transfer elements, to the outlet;

a first pump for pumping the water to increase a pressure of the water from an initial pressure to a first pressure, which is greater than the initial pressure, and to introduce the water at the first pressure into the preheating heat transfer elements within the heat exchanger for indirect heat exchange with the bulk solids to preheat the water;

a second pump in fluid communication with the preheating heat transfer elements for receiving the water therefrom, increasing the pressure of the water received to a second pressure that is greater than the first pressure and introducing the water at the second pressure into the first set of heat transfer elements for further heating;

a restriction in fluid communication with the first set of heat transfer elements and configured to receive the water at the second pressure and at an increased temperature from the first set of heat transfer elements, and to reduce the pressure of the water;

a flash vessel coupled to the restriction and configured to receive the water at reduced pressure after passing through the restriction to flash off steam from the water received at the reduced pressure, valves and piping to combine the water from the preheating heat transfer elements and water from the flash vessel, outside the flash vessel, to provide a combined water, wherein the combined water is in fluid communication with the second pump for providing the combined water to the second pump, such that the second pump increases the pressure of the combined water and introduces the combined water at the second pressure into the first set of heat transfer elements for further heating;

wherein the apparatus is configured such that water from the preheating heat transfer elements is only introduced into the flash vessel after passing through the first heat transfer elements at the second pressure.

13. The apparatus according to claim 12, comprising a further set of heat transfer elements disposed between the inlet and the outlet, wherein the flash vessel is in fluid communication with the further set of heat transfer elements and configured to introduce the steam into the further set heat transfer elements to indirectly heat the steam to provide superheated steam.

14. The apparatus according to claim 13, wherein the further set of the heat transfer elements comprise steam heat transfer tubes for the flow of the steam through the steam heat transfer tubes and the flow of the bulk solids between the steam heat transfer tubes.

15. The apparatus according to claim 12, comprising a further set of heat transfer elements disposed between the inlet and the outlet, wherein the further set of heat transfer elements are disposed between the preheating heat transfer elements and the first set of heat transfer elements.

16. The apparatus according to claim 12, wherein the preheating heat transfer elements comprise heat transfer plate assemblies arranged generally parallel to each other for the flow of the water through the heat transfer plate assemblies and the flow of the bulk solids between the heat transfer plate assemblies.

17. The apparatus according to claim 12 wherein the first heating heat transfer elements comprise first heat transfer tubes for the flow of water through the first heat transfer tubes and the flow of the bulk solids between the first heat transfer tubes.

18. The apparatus according to claim 12, wherein the outlet is arranged for choked flow of the bulk solids through the heat exchanger.

19. The apparatus according to claim 12, comprising a discharge hopper disposed proximal the outlet for controlling a flow rate of the bulk solids through the heat exchanger and thus controlling residence time in the heat exchanger.

20. The apparatus according to claim 12, wherein the second pump is configured to pressurize the water from the preheating heat transfer elements and the flash vessel to a pressure of 60 bar(g).

21. The apparatus according to claim 20, wherein the first pump is configured to pressurize the water introduced into the preheating heat transfer elements to a pressure of 20 bar(g).

* * * * *